US010889140B2

(12) United States Patent
Thony et al.

(10) Patent No.: US 10,889,140 B2
(45) Date of Patent: Jan. 12, 2021

(54) SECURITY ELEMENT OR DOCUMENT AND PROCESS OF PRODUCING THE SAME

(71) Applicant: KBA-NOTASYS SA, Lausanne (CH)

(72) Inventors: Emmanuel Thony, Lausanne (CH); Hervé Guillerey, La Conversions (CH); Mathieu Brichon, Morrens (CH); Aurélie Berthon, Villars-sous-Yens (CH); Johannes Schaede, Würzburg (DE)

(73) Assignee: KBA-Notasys SA, Lausanne (CH)

( * ) Notice: Subject to any disclaimer, the term of this patent is extended or adjusted under 35 U.S.C. 154(b) by 0 days.

(21) Appl. No.: 16/604,969

(22) PCT Filed: Mar. 12, 2018

(86) PCT No.: PCT/EP2018/056054
§ 371 (c)(1),
(2) Date: Oct. 11, 2019

(87) PCT Pub. No.: WO2018/206180
PCT Pub. Date: Nov. 15, 2018

(65) Prior Publication Data

US 2020/0384792 A1 Dec. 10, 2020

(30) Foreign Application Priority Data

May 12, 2017 (EP) ..... 17170921

(51) Int. Cl.
*B42D 25/351* (2014.01)
*B42D 25/36* (2014.01)
(Continued)

(52) U.S. Cl.
CPC ..... *B42D 25/351* (2014.10); *B42D 25/29* (2014.10); *B42D 25/309* (2014.10); *B42D 25/36* (2014.10)

(58) Field of Classification Search
CPC ..... B42D 25/351
See application file for complete search history.

(56) References Cited

U.S. PATENT DOCUMENTS 4,892,336 A 1/1990 Kaule et al.
5,712,731 A * 1/1998 Drinkwater ..... G02B 5/1885 359/619
(Continued)

FOREIGN PATENT DOCUMENTS

DE 10 2010 019 766 11/2011
EP 0 723 864 7/1996
(Continued)

OTHER PUBLICATIONS

Notice of Rejection dated Mar. 17, 2020 issued in Japanese Application No. 2019-553938 with machine English translation (11 pages).
(Continued)

*Primary Examiner* — Kyle R Grabowski
(74) *Attorney, Agent, or Firm* — Nixon & Vanderhye P.C.

(57) ABSTRACT

There is described a security element (EL) or document (BN), such as a banknote, comprising (i) a substrate (S) with first and second sides (I, II) and exhibiting at least one window region (W) made of a substantially transparent material, (ii) a micro-optical structure (OP) provided on the first side (I) of the substrate (S) and extending over at least a part of the window region (W), and (iii) a printed feature (P1-P3) printed on the second side (II) of the substrate (S) over at least a part of the window region (W), the printed feature (P1-P3) being provided in register with the micro-optical structure (OP) to produce an optically-variable effect (EF) upon looking at the printed feature (P1-P3) from the first side (I) of the substrate (S) through the micro-optical structure (OP) and the window region (W). The security element (EL) or document (BN) further comprises a pro-
(Continued)

tective layer (L) acting as printable primer layer and provided on the second side (II) of the substrate (S) over the window region (W) and on top of the printed feature (P1-P3), which protective layer (L) covers the printed feature (P1-P3) when seen from the second side (II) of the substrate (S) and further acts as a contrast-enhancing layer for the optically-variable effect (EF).

19 Claims, 10 Drawing Sheets

(51) Int. Cl.
*B42D 25/309* (2014.01)
*B42D 25/29* (2014.01)

(56) References Cited

U.S. PATENT DOCUMENTS

| | | | | |
|---|---|---|---|---|
| 8,740,253 | B2 * | 6/2014 | Batistatos | B42D 25/405 283/91 |
| 9,132,690 | B2 | 9/2015 | Raymond et al. | |
| 9,383,588 | B2 | 7/2016 | Raymond et al. | |
| 9,994,062 | B2 * | 6/2018 | Schilling | G02B 3/0056 |
| 2008/0246894 | A1 * | 10/2008 | Power | B42D 25/29 349/1 |
| 2010/0029960 | A1 | 2/2010 | Fan et al. | |
| 2010/0165425 | A1 | 7/2010 | Tompkin et al. | |
| 2013/0063826 | A1 | 3/2013 | Hoffmuller et al. | |
| 2013/0069360 | A1 * | 3/2013 | Power | B42D 25/351 283/85 |
| 2020/0031158 | A1 * | 1/2020 | Sun | G02B 3/06 |

FOREIGN PATENT DOCUMENTS

| | | | |
|---|---|---|---|
| EP | 0 949 069 | | 10/1999 |
| GB | 2514030 | | 11/2014 |
| GB | 2514030 | A | 11/2014 |
| JP | 2010-529913 | A | 9/2010 |
| JP | 2011-529913 | A | 12/2011 |
| JP | 2014-524847 | A | 9/2014 |
| JP | 2015-509058 | A | 3/2015 |
| JP | 2016-536169 | A | 11/2016 |
| JP | 2017-510769 | A | 4/2017 |
| WO | 83/00659 | | 3/1983 |
| WO | 94/27254 | | 11/1994 |
| WO | 97/34767 | | 9/1997 |
| WO | 98/36913 | | 8/1998 |
| WO | 2004/076198 | | 9/2004 |
| WO | 2007/020048 | | 2/2007 |
| WO | 2007/042919 | | 4/2007 |
| WO | 2008/031170 | A1 | 3/2008 |
| WO | 2008/104904 | | 9/2008 |
| WO | 2009/022317 | | 2/2009 |
| WO | 2009/044352 | | 4/2009 |
| WO | 2013/000012 | A1 | 1/2013 |
| WO | 2013/132448 | | 9/2013 |
| WO | 2014/125454 | | 8/2014 |
| WO | 2015/022612 | | 2/2015 |
| WO | 2015/022612 | A1 | 2/2015 |
| WO | 2015/032515 | | 3/2015 |
| WO | 2015/107488 | | 7/2015 |
| WO | 2016/042482 | | 3/2016 |
| WO | 2016/102187 | | 6/2016 |
| WO | 2017/077477 | | 5/2017 |
| WO | 2017/077478 | | 5/2017 |
| WO | 2018/031170 | | 2/2018 |

OTHER PUBLICATIONS

International Search Report for PCT/EP2018/056054 dated Apr. 10, 2018, 3 pages.
Written Opinion of the ISA for PCT/EP2018/056054 dated Apr. 10, 2018, 7 pages.

* cited by examiner

FRONT SIDE I

REVERSE SIDE II

SECURITY ELEMENT OR DOCUMENT AND PROCESS OF PRODUCING THE SAME

This application is the U.S. national phase of International Application No. PCT/EP2018/056054 filed Mar. 12, 2018 which designated the U.S. and claims priority to EP Patent Application No. 17170921.5 filed May 12, 2017, the entire contents of each of which are hereby incorporated by reference.

TECHNICAL FIELD

The present invention generally relates to a security element or document, such as a banknote, and a process of producing the same. More precisely, the invention relates to such a security element or document that comprises a substrate with first and second sides and exhibiting at least one window region made of a substantially transparent material, a micro-optical structure provided on the first side of the substrate and extending over at least a part of the window region, and a printed feature printed on the second side of the substrate over at least a part of the window region, the printed feature being provided in register with the micro-optical structure to produce an optically-variable effect upon looking at the printed feature from the first side of the substrate through the micro-optical structure and the window region.

BACKGROUND OF THE INVENTION

Such a security element or document is already known in the art, for instance from International Publication No. WO 94/27254 A1.

International Publication No. WO 94/27254 A1 especially discloses such a security element and document (see in particular the illustration of FIG. 5 of WO 94/27254 A1) where the optically-variable effect is based on the so-called "moiré magnification" principle, a well-known principle relying upon the interaction between an array of e.g. micro-lenses overlaid onto a corresponding array of micro-images, which arrays are provided one with respect to the other with a slight pitch mismatch (especially a slight angular misalignment between the two arrays), leading to magnified replication of the micro-images when looking at the device from the side where the micro-lenses are provided. The underlying principle of such a device is for instance disclosed in "The moiré magnifier", M. C. Hutley, R. Hunt, R. F. Stevens and P. Savander, Pure and Applied Optics, Journal of the European Optical Society Part A 3, pp. 133-142 (1994), and in the "Properties of moiré magnifiers", H. Kamal, R. Völkel and J. Alda, Optical Engineering 37 (11), pp. 3007-3014 (November 1998).

Such security elements or documents can also rely on an interlacing of different images (or frames) along one or two directions, as disclosed for instance in U.S. Pat. Nos. 4,892,336, 9,132,690 B2 and 9,383,588 B2 and International Publication No. WO 2007/020048 A2.

A problem with the solution disclosed in FIG. 5 of International Publication No. WO 94/27254 A1 in particular resides in that the printed feature that is printed in the window region is visible and exposed on the second side of the substrate, and only contributes to the creation of the optically-variable effect when seen from the first side of the substrate, through the micro-optical structure and window region. The printed feature is therefore prone to substantial degradation during the life-cycle of the security document, which inherently affects and deteriorates the quality of the desired effect. In practice, this has therefore led the man skilled in the art to integrate the security element per se as a security thread or a transfer element that is only exposed on the side where the micro-optical structure is provided. One illustrative example thereof is for instance the US $100 note that entered circulation in 2013 and exhibits a so-called "Motion" thread embedded in the substrate as a one-sided windowed thread that is only visible from the front side of the note, next to the portrait of President Benjamin Franklin. This avenue however restricts the freedom of the security designer and printer as the security element is not anymore producible at the printing works, but either has to be embedded in the substrate material during production thereof (like in the case of the aforementioned US $100 note) or has to be supplied as a high-cost consumable, such as a transfer element that is applied on one side of the substrate by e.g. hot-stamping techniques.

Coming back to the solution disclosed in FIG. 5 of International Publication No. WO 94/27254 A1, a further problem resides in that image contrast of the resulting optically-variable effect is poor as the optical effect is observed through a substantially-transparent medium, the only contrasting elements being created by the printed feature that is printed in the window region on the second side of the substrate. It is in particular difficult to clearly discriminate and distinguish the optically-variable effect as the image contrast depends on the relevant background against which the security element or document is held by the observer, as well as the relevant lighting conditions.

An improved solution is thus required.

International Publication No. WO 2008/031170 A1 discloses a security document comprising a substrate including at least one region of transparent or translucent plastics material forming a window or halfwindow area, and a security device integrated into the window or half-window area, wherein the security device is formed from an embossed radiation curable ink, the security device including one or more of a diffractive structure, a lens structure or other security element having an embossed relief structure.

The publication DE 10 2010 019 766 A1 discloses a method for producing a microstructure on a carrier by: (a) manufacturing a donor foil by forming an embossed structure with elevations and depressions in a first foil material and applying a transfer layer to the embossed structure, (b) manufacturing an acceptor foil by applying an adhesive layer to a second foil material, (c) laminating the donor foil and the acceptor foil by means of the adhesive layer, the transfer layer on the elevations of the embossed structure bonding to the adhesive layer, and (d) transferring the bonded regions of the transfer layer to the acceptor foil by separating the donor foil and the acceptor foil from each other, thereby forming in the acceptor foil a first microstructure from the transferred regions of the transfer layer, and/or forming in the donor foil a second microstructure complementary to the first microstructure.

The publication GB 2 514 030 A discloses a three-dimensional security element and an injection-molded product having the three-dimensional security element, wherein the three-dimensional security element further comprises: a micro lens array to which various types of lenses can be applied; an image array; a primer layer for facilitating adhesion; and a protection film for protecting the three-dimensional security element from heat and pressure.

SUMMARY OF THE INVENTION

A general aim of the invention is therefore to provide an improved solution, namely such a security element or document where the optically-variable effect exhibits and maintains a better quality and image contrast over its life-cycle.

A further aim of the invention is to provide such a solution that provides greater freedom to the security designer and printer in terms of design opportunities and printing possibilities, and improves printability of the substrate on the side opposite to the side where the micro-optical structure is provided.

Yet another aim of the invention is to provide such a solution that is more easily producible at the printing works and that does not rely upon the use of high-cost consumables.

These aims are achieved thanks to the solutions defined in the claims.

In accordance with the invention, there is provided a security element or document, such as a banknote, comprising a substrate with first and second sides and exhibiting at least one window region made of a substantially transparent material, a micro-optical structure (provided on the first side of the substrate and extending over at least a part of the window region, and a printed feature printed on the second side of the substrate over at least a part of the window region, the printed feature being provided in register with the micro-optical structure to produce an optically-variable effect upon looking at the printed feature from the first side of the substrate through the micro-optical structure and the window region. According to the invention, the security element or document further comprises a protective layer acting as printable primer layer and provided on the second side of the substrate over the window region and on top of the printed feature, which protective layer covers the printed feature when seen from the second side of the substrate and further acts as a contrast-enhancing layer for the optically-variable effect.

Preferably, the micro-optical structure consists of an array of micro-lenses, especially hemicylindrical or hemispherical micro-lenses.

The micro-optical structure can advantageously be provided onto the window region, preferably by hot-stamping, in the form of a foil carrying the micro-optical structure, or be formed directly onto the window region, especially by embossing or casting.

The printed feature is a multicolour feature printed by Simultan offset printing, which printing process is only used in the context of the production of security documents, such as banknotes.

In accordance with an embodiment of the invention, the protective layer is overprinted on top of the printed feature by screen printing, which allows achieving a good and uniform coverage of the window region and printed feature, and leads to optimum printability of the relevant portion on the second side of the substrate. Screen printing is typically used in printing works and is therefore readily available to apply the required protective layer. In this context, the protective layer has a substantially uniform colour appearance that closely matches that of an unprinted surface of the substrate, especially a white appearance. Tests carried out by the Applicant have furthermore demonstrated that the best results are achieved if use is made of a UV-cured material to print the protective layer.

In accordance with a possible refinement of the invention, a functional layer could furthermore be interposed between the printed feature and the protective layer. Such functional layer could in particular be a mirror-effect layer or an optically-responsive layer that produces an optical response when subjected to an illumination stimulus outside of the visible spectrum, such as UV light.

Preferably, the substrate is selected from the group of substrates consisting of:

(i) a paper substrate comprising at least one opening extending through the substrate and filled with transparent material where the at least one window region is provided;

(ii) a polymer substrate comprising at least one transparent layer of polymer material, which polymer substrate is provided on each side with an opacifying layer, each opacifying layer exhibiting at least one opening where the at least one window region is provided; and (iii) a paper-polymer hybrid substrate comprising at least one transparent layer of polymer material bonded to at least one paper layer, which paper layer is provided with at least one opening extending through the paper layer where the at least one window region is provided.

Advantageously, the security element or document further comprises a printed pattern that is printed on top of the protective layer, especially by intaglio printing.

There is also provided a process of producing a security element or document, such as a banknote, comprising the following steps:

providing a substrate having first and second sides, which substrate exhibits at least one window region made of a substantially transparent material;

providing a micro-optical structure on the first side of the substrate and extending over at least a part of the window region;

printing a printed feature on the second side of the substrate over at least a part of the window region, the printed feature being provided in register with the micro-optical structure to produce an optically-variable effect upon looking at the printed feature from the first side of the substrate through the micro-optical structure and the window region; and applying a protective layer acting as printable primer layer on the second side of the substrate over the window region and on top of the printed feature, which protective layer covers the printed feature when seen from the second side of the substrate and further acts as a contrast-enhancing layer for the optically-variable effect.

The step of providing the micro-optical structure and the step of printing the printed feature are carried out in one and a same operation. This is achievable thanks in particular to a combined casting and printing platform as for instance disclosed in European Patent Application No. 17157503.8 of Feb. 22, 2017 and European Patent Application No. 17167792.5 of Apr. 24, 2017 both in the name of the instant Applicant and entitled "PRINTING PRESS WITH IN-LINE CASTING DEVICE FOR THE REPLICATION AND FORMATION OF A MICRO-OPTICAL STRUCTURE"

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of an application to a banknote. It is however to be appreciated that the invention is applicable to the production of any security element or document, including for instance passports and like ID documents or other types of value or security document. Furthermore, while the illustrations of FIGS. 1*a*-1*b* to 5*a*-5*b* show different steps of the production of an individual banknote, it should be appreciated that banknotes are typically produced in the form of individual sheets or successive portions of a continuous web of substrate material, each carrying multiple impressions that are ultimately cut into individual banknotes (see for instance International Publication No. WO 2009/044352 A1 and WO 2013/132448 A1, which provide an overview of how banknotes and like security documents are produced).

Within the scope of the present invention, the expression "window region" designates any substantially transparent or translucent region formed in the relevant substrate material and that is, at least initially (i.e. before application of the relevant printed feature and protective layer), visible from both sides of the substrate. The invention is not limited to any particular configuration, shape and dimensions of the relevant window region. In particular, one or more window regions could be provided.

As regards the substrate, any suitable substrate material convenient for the production of the desired security element or document could be used. This preferably includes any substrate selected from the group of substrates consisting of:

(i) a paper substrate comprising at least one opening extending through the substrate and filled with transparent material where the at least one window region is provided (as for instance disclosed in International Publications Nos. WO 2015/022612 A1 and WO 2015/107488 A1, the content of which publications is incorporated herein by reference in its entirety);

(ii) a polymer substrate comprising at least one transparent layer of polymer material, which polymer substrate is provided on each side with an opacifying layer, each opacifying layer exhibiting at least one opening where the at least one window region is provided (as for instance disclosed in International Publications Nos. WO 83/00659 A1 and WO 98/36913 A1, the content of which publications is likewise incorporated herein by reference in its entirety—see also FIG. 5 of WO 94/27254 A1); and (iii) a paper-polymer hybrid substrate comprising at least one transparent layer of polymer material bonded to at least one paper layer, which paper layer is provided with at least one opening extending through the paper layer where the at least one window region is provided (as for instance disclosed in International Publications Nos. WO 2004/076198 A1 and WO 2014/125454 A1, the content of which publications is also incorporated herein by reference in its entirety).

Figure 6:
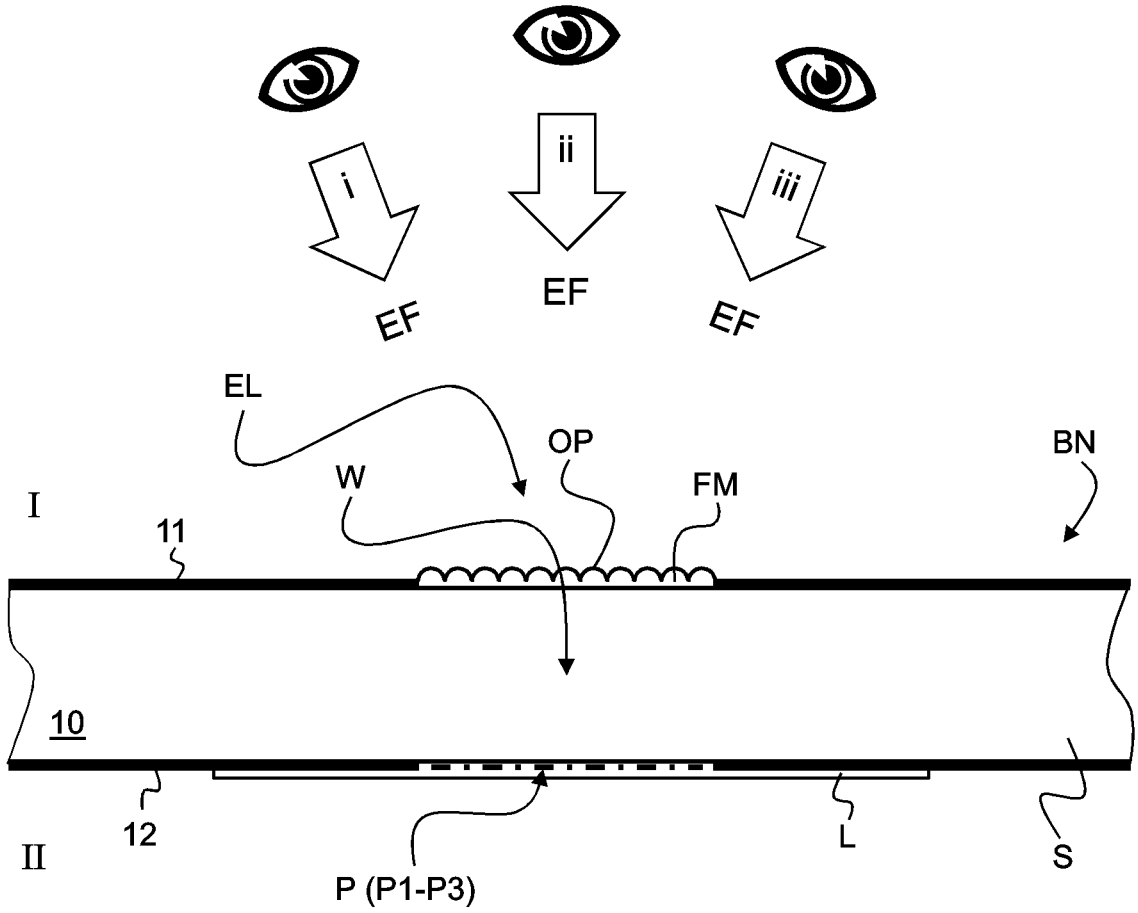
FIG. 6 is a cross-sectional view of a security element or document in accordance with one embodiment of the invention, where the substrate is a polymer substrate comprising at least one transparent layer of polymer material, which polymer substrate is provided on each side with an opacifying layer exhibiting an opening where the window region is provided.

The following embodiments will be discussed in the particular context of a substrate in accordance with (ii) above. As schematically illustrated in FIG. 6, the substrate, designated by reference S, can in particular be a polymer substrate that basically comprises at least one transparent layer of polymer material 10, such as biaxially oriented polypropylene (BOPP), which polymer substrate is provided on each side with an opacifying layer 11, resp. 12, each opacifying layer 11, 12 exhibiting at least one opening where the relevant window region, designated by reference W, is provided. In this particular case, it will therefore be understood that the window region W is formed of the transparent layer 10 and that the configuration and shape of the window region W is defined by the relevant configuration and shape of the openings formed in the two opacifying layers 11, 12.

In accordance with the invention, and as illustrated schematically in FIG. 6, on wishes to create a security element EL or document BN comprising:

- a substrate S with first and second sides I, II and exhibiting at least one window region W made of a substantially transparent material;
- a micro-optical structure OP provided on the first side I of the substrate S and extending over at least a part of the window region W;
- a printed feature, designated by references P1-P3 in FIG. 6, printed on the second side II of the substrate S over at least a part of the window region W, the printed feature P1-P3 being provided in register with the micro-optical structure OP to produce an optically-variable effect EF upon looking at the printed feature P1-P3 from the first side I of the substrate S through the micro-optical structure OP and the window region W; and
- a protective layer L acting as printable primer layer and provided on the second side II of the substrate S over the window region W and on top of the printed feature P1-P3, which protective layer L covers the printed feature P1-P3 when seen from the second side II of the substrate S and further acts as a contrast-enhancing layer for the optically-variable effect EF.

Figure 1A:
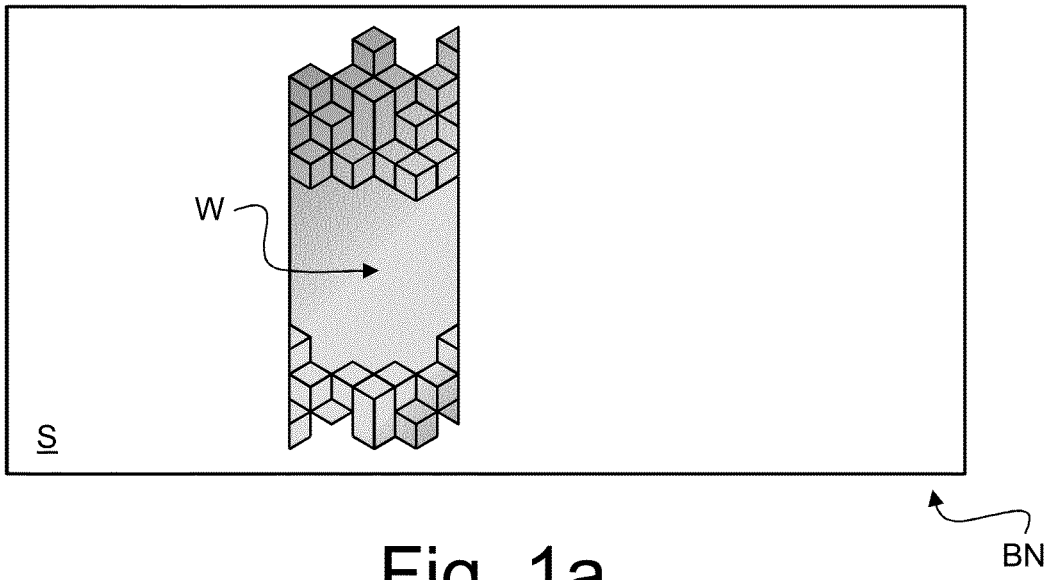
FIGS. 1*a* and 1*b* are schematic views of a security document seen from a front side and a reverse side of the relevant substrate, which substrate exhibits a window region visible from both sides.
Figure 1B:
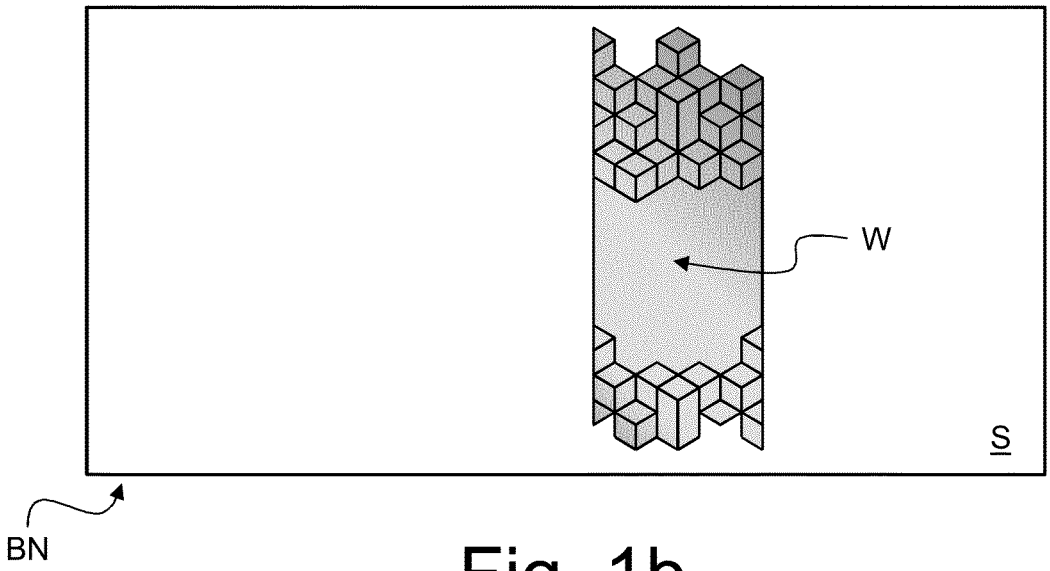

FIGS. 1*a* and 1*b* are schematic views of a security document BN (such as a banknote) seen from a front side I and a reverse side II of the substrate S, which substrate S exhibits a window region W visible from both sides I, II. As mentioned above, it will be assumed for the sake of illustration that the substrate S is a polymer substrate. For the sake of explanation, FIGS. 1*a* and 1*b* depict the substrate S without the additional features that ultimately contribute to forming the security element or document of the invention, namely without the micro-optical structure OP, printed feature P1-P3 and protective layer L.

The window region W shown in FIGS. 1*a* and 1 *b* can in particular be created by structuring the aforementioned opacifying layers (11, 12 in FIG. 6) in such a way as to leave an open region where the inner transparent layer 10 is exposed to create the window region W. Any desired configuration and shape can be imparted to the window region W by appropriately structuring the opacifying layers 11, 12 on both sides I, II of the substrate S. As schematically illustrated in FIGS. 1*a* and 1 *b*, part of the opacifying layers 11, 12 can in particular remain inside the surface of the window region W, on one or both sides I, II, to create any desired design in the window region W (such as geometrical patterns as depicted).

Figure 2A:
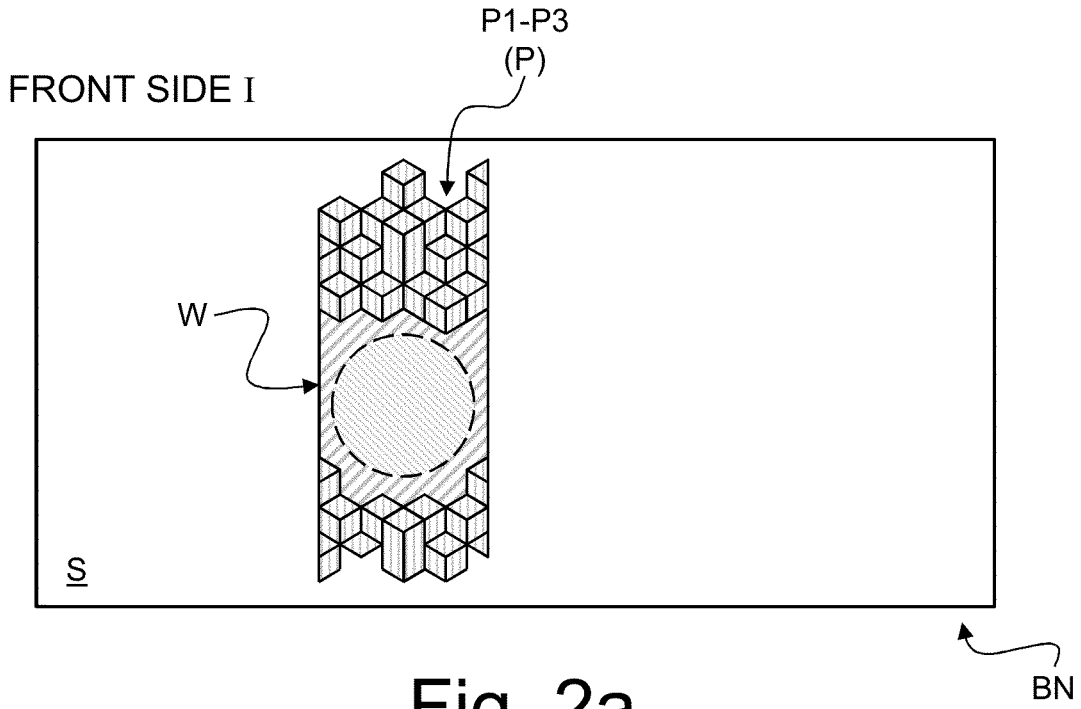
FIGS. 2*a* and 2*b* are schematic view of the security document of FIGS. 1*a* and 1 *b*, where the reverse side of the substrate has been provided with a printed pattern, including a printed feature provided on the window region.

In accordance with the invention, a printed feature is printed on the second side II of the substrate S over at least a part of the window region W. As shown in the illustrative example of FIGS. 2*a* and 2*b*, a printed pattern P can in particular be provided on the second side II of the substrate S such as to at least partially overlap with the window region W. A part of this printed pattern P, which is printed in the window region W, consists of a printed feature P1-P3 that ultimately forms part of the security element of the invention. As illustrated in FIG. 2*a*, this printed feature P1-P3 is visible from the first side I of the substrate S through the window region W.

More precisely, in the illustrated example, the printed feature P1-P3 comprises a series of printed elements P1, P2, P3 that are structured to ultimately create corresponding optically-variable effects, when combined with an associated micro-optical structure provided on the first side I of the substrate S (which micro-optical structure is not shown in FIG. 2*a*). For the sake of illustration, printed elements P1 and P2 could for instance be designed in order to create corresponding optically-variable effects in accordance with the aforementioned moiré magnification principle. In contrast, printed element P3 could be designed differently, as a multicolour element with interlaced lines of different colours which, when combined with the associated micro-optical structure, will generate a colour-shifting effect in dependence on the point of view.

As a matter of fact, any desired design could be printed in the window region W on the second side II of the substrate S and it will be appreciated that the security designer is basically free to design and combine various printed elements in different ways to create the desired printed feature, which highlights the considerable advantage of the present invention over the known solutions that rely upon the use of a security thread or security device that is embedded in or applied on the substrate as the relevant security element.

The printed feature is a multicolour feature that is printed by Simultan offset printing, which printing process is already used in the art of security printing. Simultan offset printing relies upon the use of a specific offset printing press (such as the Super Simultan® IV or Super Orlof Simultan® printing presses marketed by the present Applicant) where multiple ink patterns are collected on a common blanket cylinder before transfer onto the substrate. Simultan offset printing presses are known as such in the art, in particular from European Patent Publication No. EP 0 949 069 A1, International Publications Nos. WO 2007/042919 A2, WO 2015/032515 A1, WO 2016/042482 A2 or even European Patent Application No. 17160749.2 of Mar. 14, 2017 in the name of the Applicant entitled "SHEET-FED PRINTING PRESS FOR SIMULTANEOUS RECTO-VERSO PRINTING OF SHEETS, IN PARTICULAR FOR THE PRODUCTION OF SECURITY DOCUMENTS".

Figure 2B:
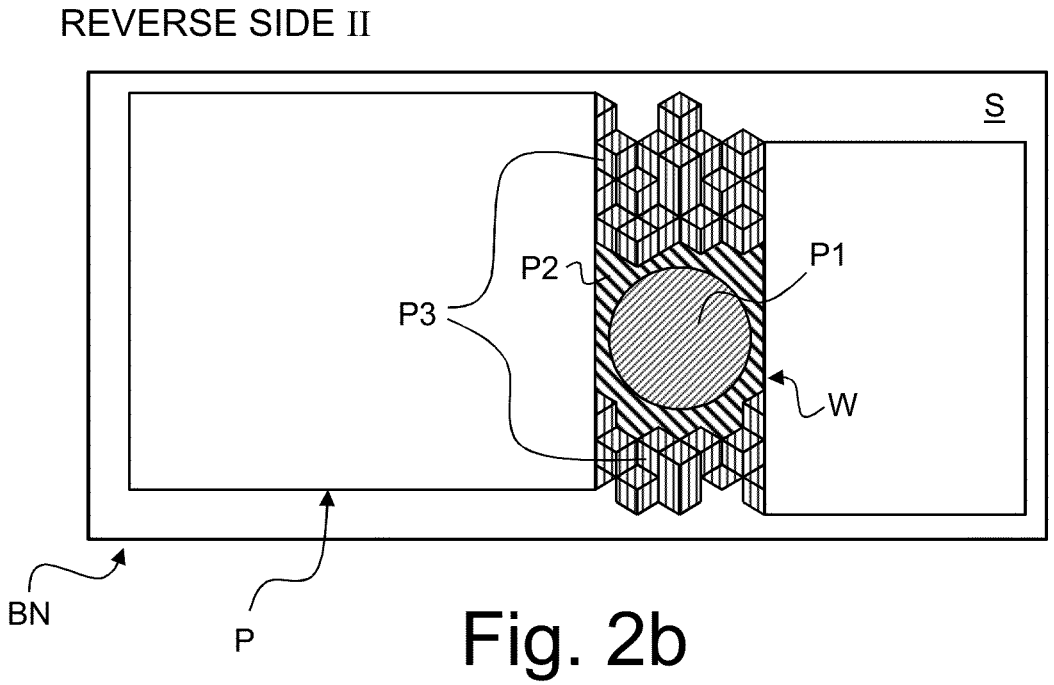

While this is not specifically illustrated in FIGS. 2*a* and 2*b*, it will be appreciated that the first side I of the substrate S could also be printed, however outside of the area of the window region W. This would typically be the case, and can once again be contemplated thanks to the use of the aforementioned Simultan offset printing presses that are typically designed for recto-verso printing of the substrate.

Figure 3A:
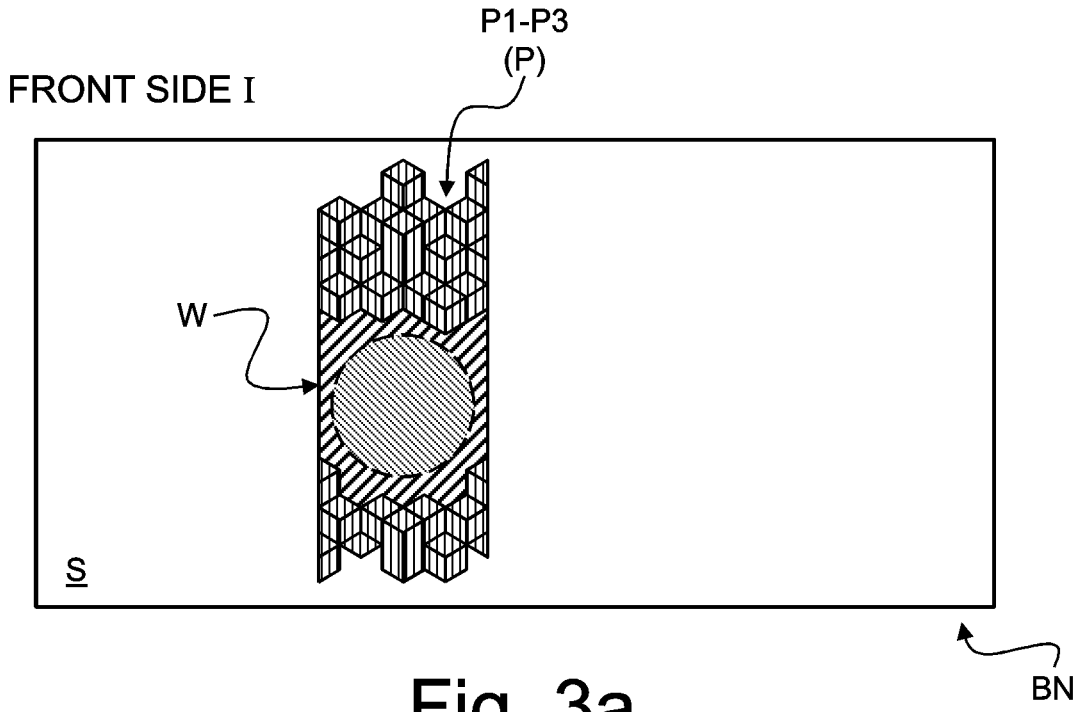
FIGS. 3*a* and 3*b* are schematic view of the security document of FIGS. 2*a* and 2*b*, where the reverse side of the substrate has additionally been provided with a protective layer over the window region and on top of the printed feature, which protective layer acts both as a printable primer layer and as a contrast-enhancing layer.
Figure 3B:
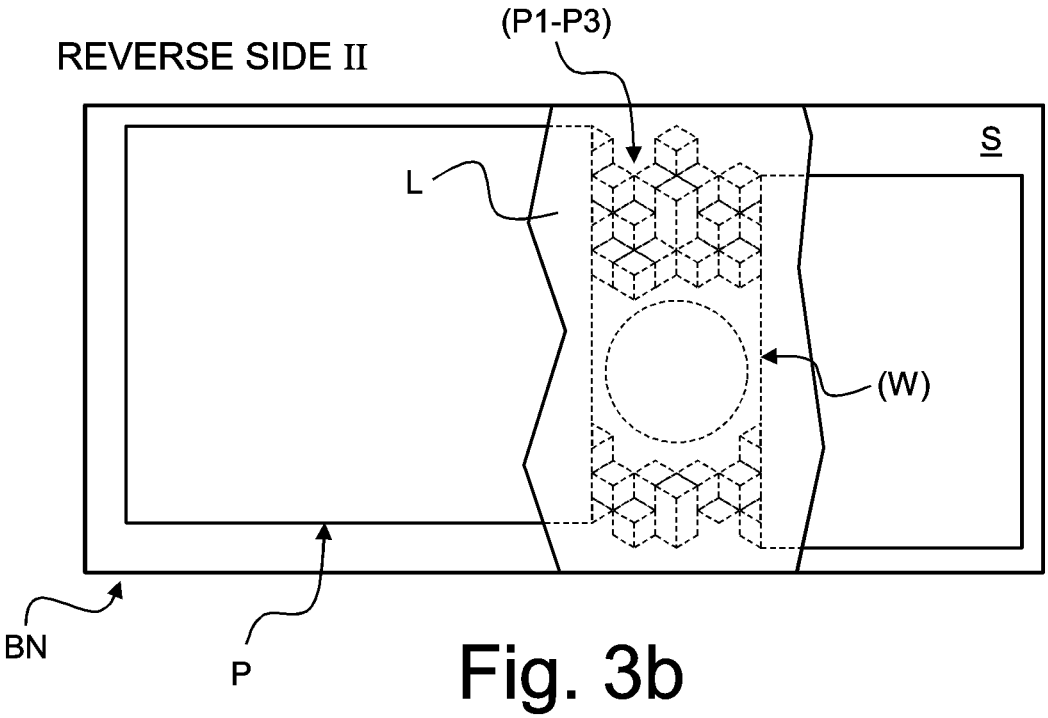

In accordance with the present invention, and as illustrated by FIGS. 3*a* and 3*b*, the second side II of the substrate S is furthermore provided with a protective layer L in such a way as to cover the window region W and the underlying printed feature P1-P3. In other words, the protective layer L is provided on the second side II of the substrate S over the window region W and on top of the printed feature P1-P3, thereby covering the printed feature P1-P3 when seen from the second side II.

A first function fulfilled by the protective layer L is to act as a printable primer layer, namely a layer that provides adequate basis for the subsequent provision of additional printed patterns. In that respect, the protective layer is overprinted on top of the printed feature P1-P3 by screen printing. Screen printing is known as such in the art and relies upon the use of a specific screen printing press as for instance marketed by the Applicant under the product designation Nota Screen®. Such a screen printing press is known for instance from European Patent Publication No. EP 0 723 864 A1 and International Publications Nos. WO 97/34767 A1, WO 2009/022317 A1 and WO 2016/102187 A1.

A considerable advantage of screen printing resides in the fact that a substantially uniform layer can be printed on the second side II of the substrate S so as to optimally act as the desired protective layer L. Screen-printed layers in particular exhibit a very good coverage, thereby efficiently acting as protective layer for the underlying printed feature P1-P3.

Furthermore, tests carried out by the Applicant have demonstrated that the use of a UV-cured material (especially a UV-curable screen printing ink) is particularly efficient in creating a very resistant protective layer L that guarantees optimal resistance to wear and tear over the life-cycle of the security element or document.

In accordance with the embodiment of the invention, the protective layer L is selected to have a substantially uniform colour appearance that closely matches that of the unprinted surface of the relevant substrate S. In this context, the protective layer L can in particular be selected to exhibit a substantially white appearance, especially such a white appearance that matches that of the aforementioned opacifying layers 11, 12.

In accordance with the invention, a further function fulfilled by the protective layer L is to act as a contrast-enhancing layer. Indeed, the protective layer L provides a well-defined surface that acts as background layer for the printed feature P1-P3 when seen from the other side of the substrate S, namely from the first side I. As schematically illustrated by FIG. 3*a*, the image contrast is substantially improved by the presence of the protective layer L. Furthermore, the presence of the protective layer L efficiently suppresses any negative influence or interference from the environment in the background and from the lighting conditions when observing the printed feature P1-P3 from the first side I. In other words, the conditions under which the printed feature P1-P3 is observable are much more stable.

It will once again be appreciated that the application of the protective layer L by by screen printing likewise opens up possibilities for the security designer to shape and structure the protective layer L in any desired way. In particular, the protective layer L could be designed so as to be fully integrated in the final design of the reverse side II of the banknote BN. By way of preference, the printed pattern P and protective layer L on the second side II of the substrate S jointly form the background design of the reverse side II of the banknote BN.

Figure 4A:
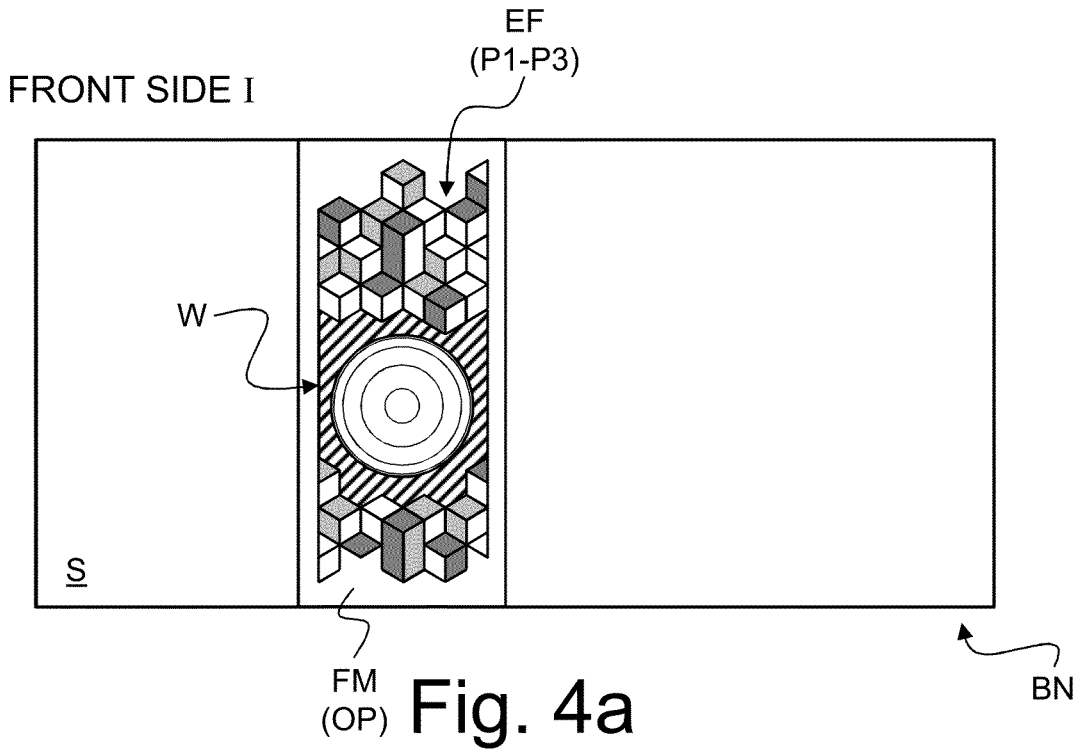
FIGS. 4*a* and 4*b* are schematic view of the security document of FIGS. 3*a* and 3*b*, where the front side of the substrate has additionally been provided with a micro-optical structure extending over at least a part of the window region, which micro-optical structure is in register with the printed feature provided on the reverse side to produce an optically-variable effect upon looking at the printed feature from the front side of the substrate through the micro-optical structure and the window region.
Figure 4B:
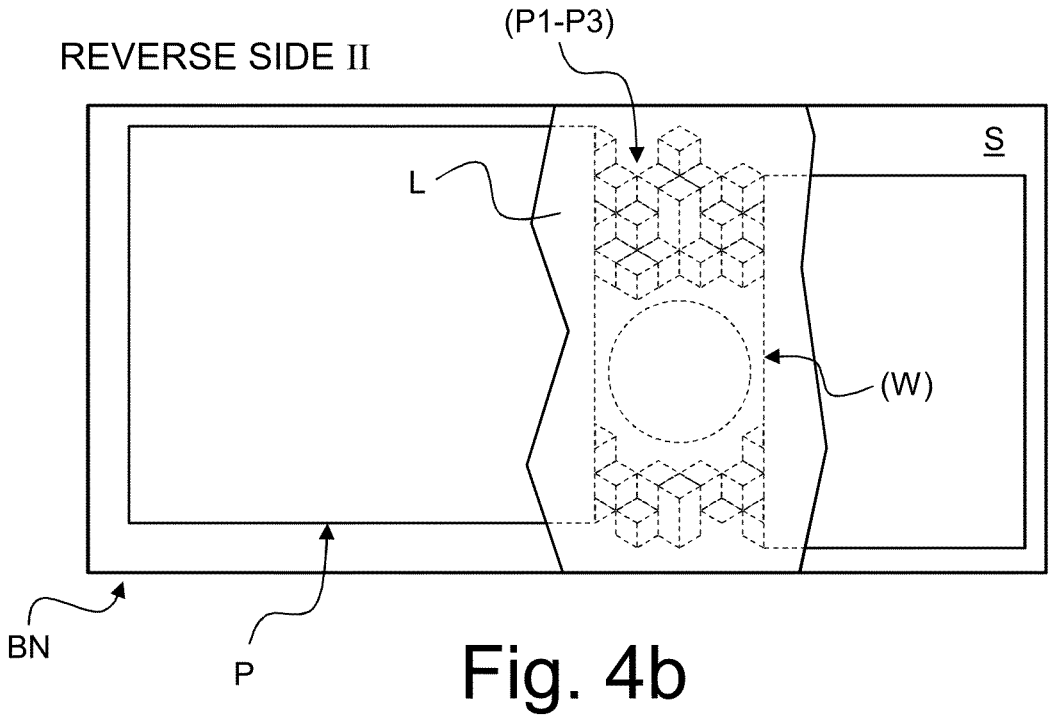

In accordance with the present invention, and as further illustrated by FIGS. 4*a* and 4*b*, the first side I of the substrate S is furthermore provided with a micro-optical structure OP, which micro-optical structure OP extends over at least part of the window region W (and is provided in register with the printed feature P1-P3 on the other side II of the window region W).

The micro-optical structure OP could be provided in various ways. It could for instance be provided on the window region W during or subsequent to the production of the substrate S, especially by embossing or casting. In accordance with a particularly advantageous embodiment, the provision of the micro-optical structure OP on the first side I of the substrate S could take place by casting simultaneously with the printing of the printed feature P1-P3 on the second side II of the substrate S. This is feasible thanks to a combined casting and printing platform as for instance disclosed in European Patent Application No. 17157503.8 of Feb. 22, 2017 and European Patent Application No. 17167792.5 of Apr. 24, 2017 both in the name of the instant Applicant and entitled "PRINTING PRESS WITH IN-LINE CASTING DEVICE FOR THE REPLICATION AND FORMATION OF A MICRO-OPTICAL STRUCTURE", the content of which applications is incorporated herein by reference in its entirety.

In the example of FIGS. 4*a* and 4*b*, the micro-optical structure OP is provided on the first side I of the substrate S in the form of foil material FM applied by a hot-stamping technique, which foil material FM carries the micro-optical structure OP. This foil material FM can in particular be applied by lamination onto the substrate using the Opti-Nota® H hot-stamping machine marketed by the Applicant, as taught for instance in International Publications Nos. WO 2008/104904 A1, WO 2017/077477 A1 and WO 2017/077478 A1, the content of which is incorporated herein by reference in its entirety.

This once again provides great freedom with respect to the production of the security element or document of the invention, in that the printer has the liberty to produce the necessary micro-optical structure OP directly at the printing works if desired.

It will be appreciated that the micro-optical structure can be formed at any appropriate stage of the production, whether before, during or after printing of the associated printed feature with which the micro-optical structure is to be combined. Key is that the micro-optical structure and associated printed features are provided on the first and second sides of the substrate in register with one another.

Preferably, the micro-optical structure OP consists of an array of micro-lenses, especially hemicylindrical or hemispherical micro-lenses. Other micro-optical structures are however possible, depending on the optically-variable effect that one wishes to ultimately generate.

Figure 7A:
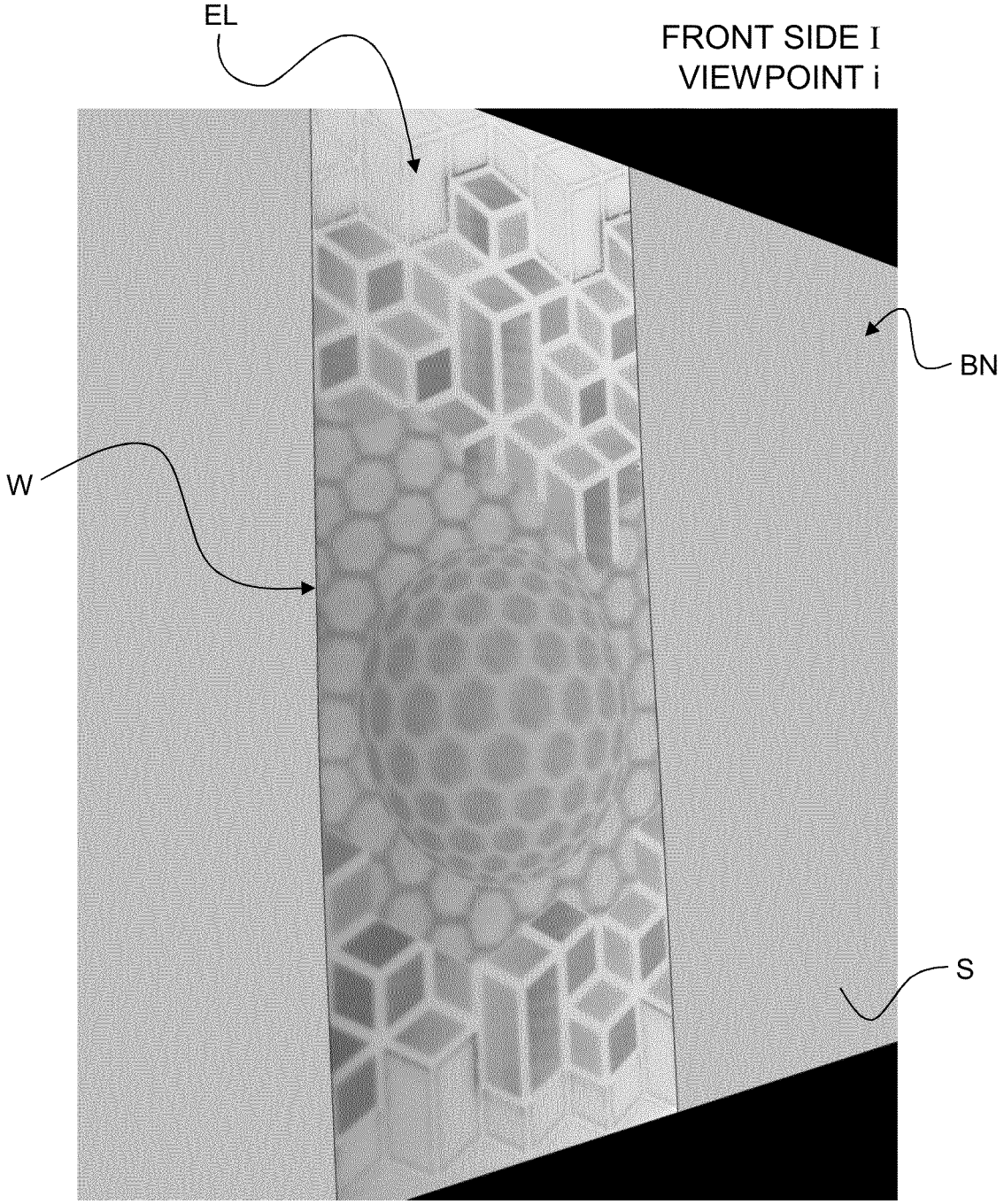
FIGS. 7*a* to 7*c* are photographic illustrations of a specimen of a security document produced in accordance with the invention, which photographic illustrations show the security element from different viewpoints.
Figure 7B:
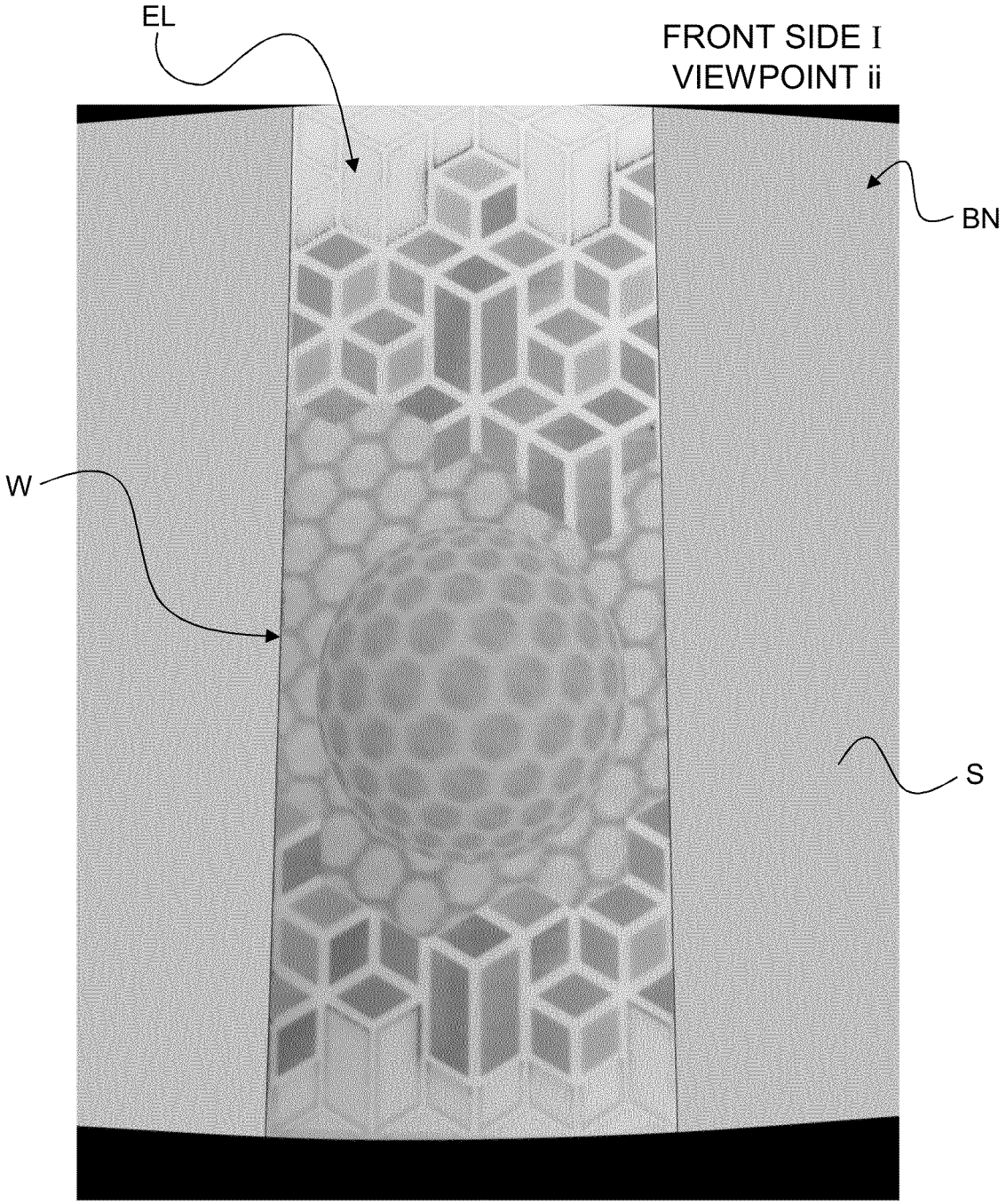
Figure 7C:
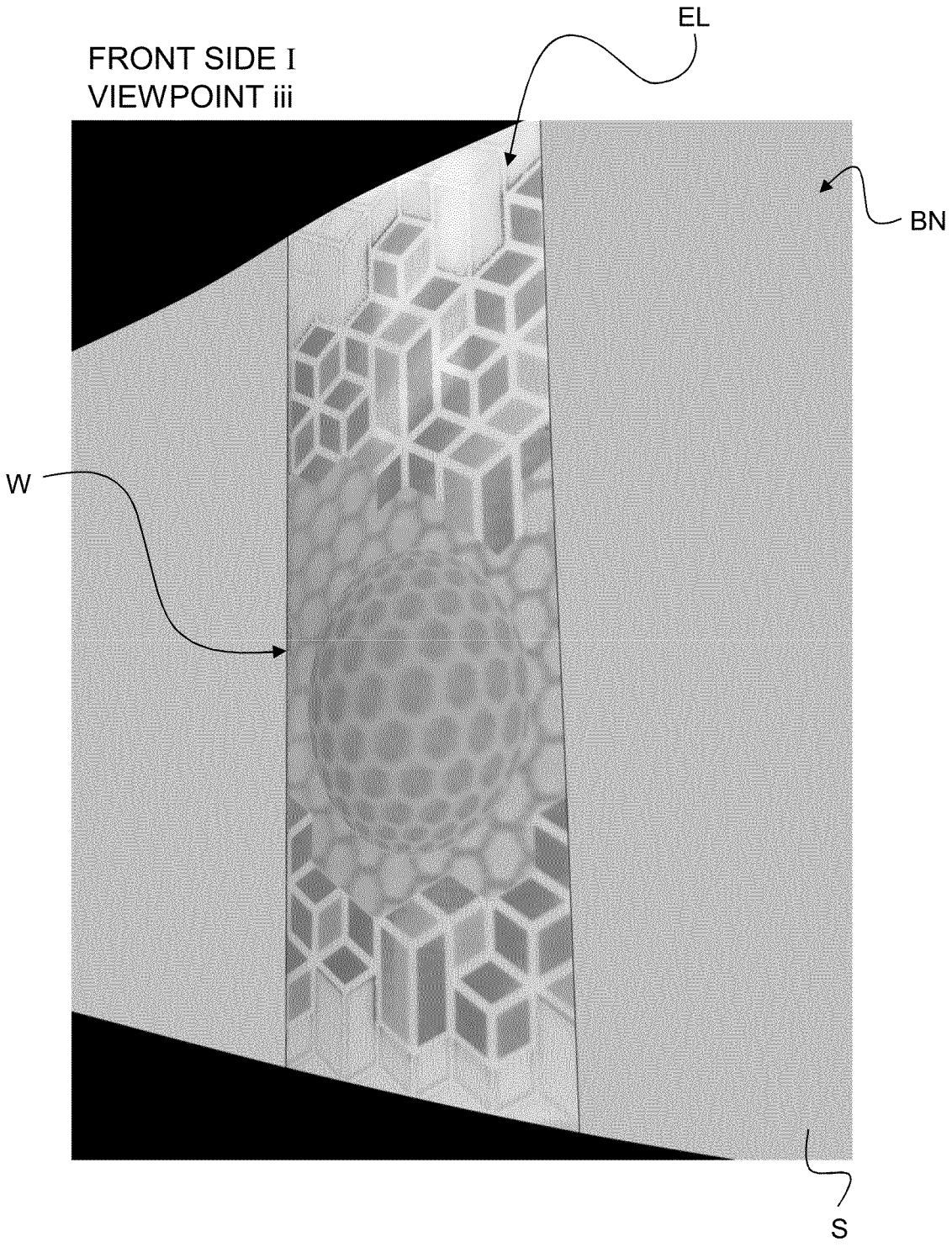
Figure 8:
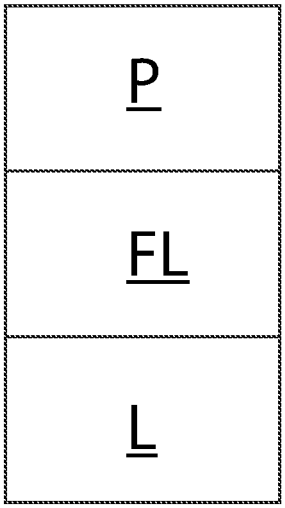
FIG. 8 is a schematic illustration of a security document with a functional layer between a printed feature and a protective layer.

As a result of the combination of the micro-optical structure OP and the printed feature P1-P3, an optically-variable effect EF is produced, which optically-variable effect EF changes in dependence of the viewpoint from which the optically-variable effect EF is observed. FIGS. 7*a* to 7*c* are photographic illustrations of a specimen of a security document BN produced in accordance with the invention, which photographic illustrations show the security element EL and resulting optically-variable effect EF from three different viewpoints i, ii and iii (as schematically illustrated in FIG. 6). As schematically illustrated in FIG. 6, the optically-variable effect EF will vary in dependence of the viewpoint from which the printed feature P1-P3 is observed from the front side I of the substrate S through the micro-optical structure OP and the window region W, with the protective layer L provided on the second side II of the substrate S acting as a contrast-enhancing layer for the optically-variable effect EF. This leads to a sharply-defined and readily recognizable effect.

Figure 5A:
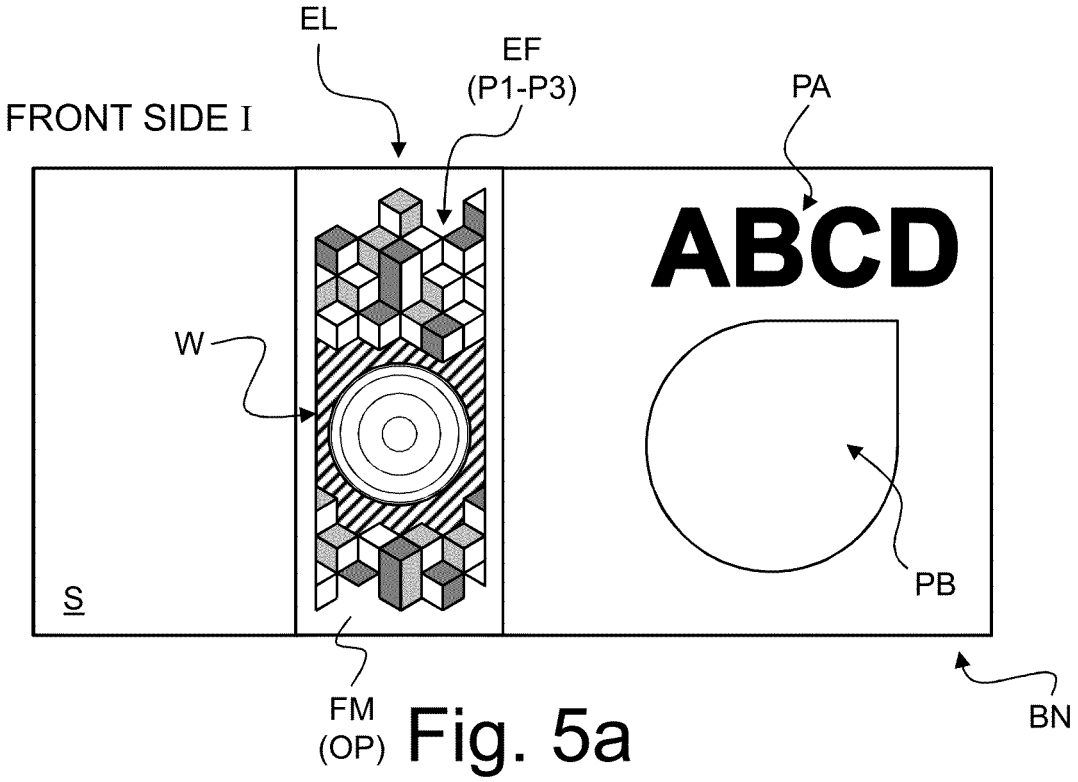
FIGS. 5*a* and 5*b* are schematic view of the security document of FIGS. 4*a* and 4*b*, where the front and reverse sides of the substrate have further been provided with additional printed patterns, including a printed pattern provided on the reverse side that at least partially overlaps with the protective layer.
Figure 5B:
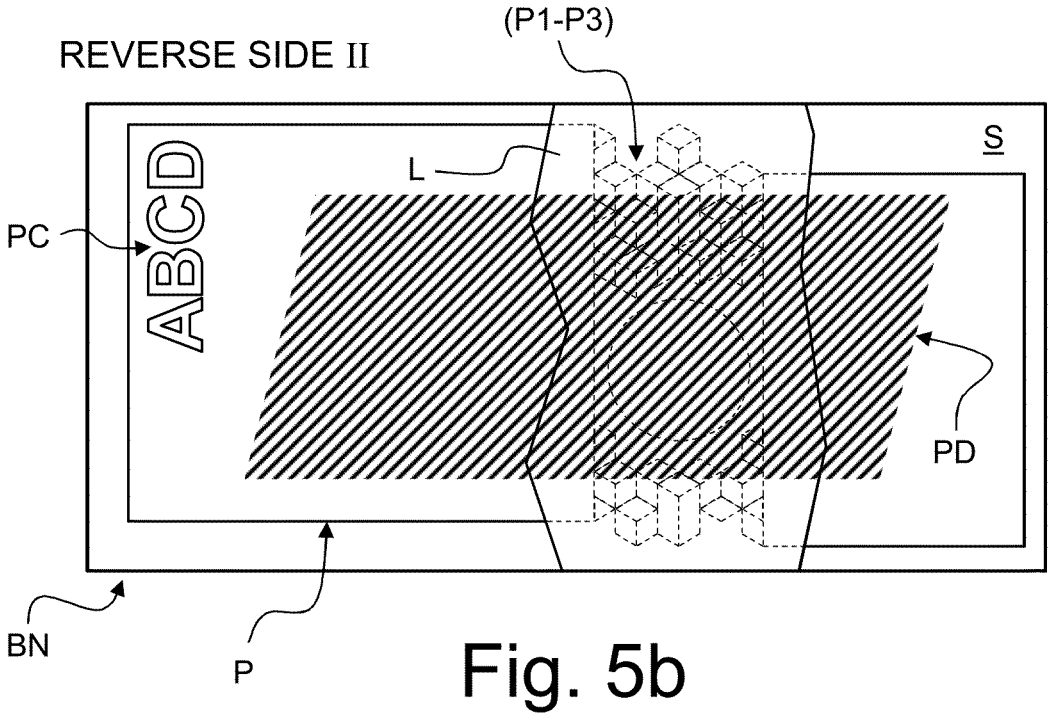

As further depicted in FIGS. 5*a* and 5*b*, one or both sides I, II of the substrate S can be provided with further printed patterns or features. FIG. 5*a* for instance shows patterns PA and PB printed (or otherwise provided) on the first side I of the substrate S, outside of the window region W. FIG. 5*b* likewise shows patterns PC and PD printed (or otherwise provided) on the second side II of the substrate S, either outside of or overlapping with the protective layer L. Pattern PD, which overlaps with the protective layer L, can in particular be created by intaglio printing. Tests carried out by the Applicant have demonstrated that intaglio printing of the reverse side II of the substrate, where the protective layer L is located, can be carried out without degrading the quality of the optically-variable effect EF, especially with substrates of the type comprising a polymer layer, as the polymer layer is typically sufficiently resilient to cope with the high printing pressure that is exerted on the substrate during intaglio printing.

A refinement of the present invention may consist is further providing a functional layer FL between the printed feature P and the protective layer L. Such functional layer may in particular be a mirror-effect layer or an optically-responsive layer that produces an optical response when subjected to an illumination stimulus outside of the visible spectrum, especially UV light.

Various modifications and/or improvements may be made to the above-described embodiments without departing from the scope of the invention as defined by the annexed claims. For instance, as already mentioned, the micro-optical structure is provided on the first side of the substrate during printing of the printed feature. Providing the micro-optical structure and printing the printed feature in one and a same operation has the advantage that register between the two components of the security element or document can be precisely controlled.

LIST OF REFERENCE NUMERALS USED THEREIN

EL security element
BN security document (e.g. banknote)
S substrate of security element EL, resp. security document BN (e.g. polymer substrate)

10 transparent layer (monolayer or multilayer) of polymer material (e.g. biaxially oriented polypropylene—BOPP—layer(s)—illustrative embodiment of FIG. 6)

11, 12 opacifying layer (e.g. white layer) provided on each side of substrate S (illustrative embodiment of FIG. 6)

I first side of substrate S (front or recto side)

II second side of substrate S (reverse or verso side)

W window region made of a substantially transparent material provided in substrate S P printed pattern provided on second side II of substrate S, including printed patterns P1-P3 (e.g. pattern printed by Simultan offset printing)

OP micro-optical structure provided on first side I of the substrate S and extending over at least a part of the window region W P1-P3 printed feature forming part of printed pattern P printed on second side II of substrate S over at least a part of window region W and provided in register with micro-optical structure OP PA, PB printed patterns (e.g. intaglio-printed patterns) provided on first side I of substrate S PC printed pattern (e.g. intaglio-printed pattern) provided on second side II of substrate S outside of the region where protective layer L is provided PD printed pattern (e.g. intaglio-printed pattern) provided on second side II of substrate S and overlapping with protective layer L EF optically-variable effect produced upon looking at printed feature P1-P3 from first side I of substrate S through micro-optical structure OP and window region W/effect changes in dependence of point of view i, ii, iii different viewpoints from which EF is observed L protective layer acting as printable primer layer applied on second side on second side II of substrate S over window region W and on top of printed feature P1-P3/contrast-enhancing layer for optically-variable effect EF (preferably FM foil material carrying micro-optical structure OP

The invention claimed is:

1. A security element or document comprising:

a substrate with first and second sides and comprising at least one window region made of a substantially transparent material;

a micro-optical structure provided on the first side of the substrate and extending over at least a part of the at least one window region;

a printed feature printed on the second side of the substrate over at least a part of the at least one window region, the printed feature being provided in register with the micro-optical structure to produce an optically-variable effect upon looking at the printed feature from the first side of the substrate through the micro-optical structure and the at least one window region; and a protective layer acting as a printable primer layer and provided on the second side of the substrate over the at least one window region and over the printed feature, wherein the protective layer covers the printed feature when seen from the second side of the substrate and further acts as a contrast-enhancing layer for the optically-variable effect, wherein the printed feature is a multicolour feature, wherein the protective layer is a layer having a substantially uniform appearance that closely matches that of a portion of the substrate that does not include the printed feature, and wherein the protective layer covers only a portion of the second side of the substrate outside of the at least one window region in addition to covering the at least one window region.

2. The security element or document according to claim 1, wherein the micro-optical structure consists of an array of micro-lenses.

3. The security element or document according to claim 2, wherein the array of micro-lenses includes hemicylindrical or hemispherical micro-lenses.

4. The security element or document according to claim 1, wherein the micro-optical structure is provided onto the window region in the form of a foil carrying the micro-optical structure.

5. The security element or document according to claim 4, wherein the micro-optical structure is provided onto the window region by hot-stamping.

6. The security element or document according to claim 1, wherein the micro-optical structure is formed directly onto the at least one window region.

7. The security element or document according to claim 6, wherein the micro-optical structure is formed by embossing or casting.

8. The security element or document according to claim 1, wherein the protective layer has a substantially white appearance.

9. The security element or document according to claim 1, wherein the protective layer is made of a UV-cured material.

10. The security element or document according to claim 1, further comprising a functional layer that is interposed between the printed feature and the protective layer, and wherein the functional layer is a mirror-effect layer or an optically-responsive layer that produces an optical response when subjected to an illumination stimulus outside of the visible spectrum.

11. The security element or document according to claim 10, wherein the functional layer is configured to produce an optical response when subjected to UV light.

12. The security element or document according to claim 1, wherein the substrate is selected from the group of substrates consisting of:

(i) a paper substrate comprising at least one opening extending through the substrate and filled with a transparent material where the at least one window region is provided;

(ii) a polymer substrate comprising at least one transparent layer of polymer material, the polymer substrate being provided on each side with an opacifying layer, each opacifying layer exhibiting at least one opening where the at least one window region is provided; and (iii) a paper-polymer hybrid substrate comprising at least one transparent layer of polymer material bonded to at least one paper layer, the paper layer being provided with at least one opening extending through the paper layer where the at least one window region is provided.

13. The security element or document according to claim 1, further comprising a printed pattern that is printed on top of the protective layer.

14. The security element or document according to claim 13, wherein the printed pattern is printed by intaglio printing.

15. The security element or document according to claim 1, wherein the security element or document is a banknote.

16. The security element or document according to claim 1, wherein the printed feature is printed by Simultan offset printing.

17. The security element or document according to claim 1, wherein the protective layer is overprinted on the printed feature.

18. The security element or document according to claim 1, wherein the protective layer is applied by screen printing.

19. The security element or document according to claim 1, wherein the substrate comprises a polymer substrate comprising at least one transparent layer of polymer material, the polymer substrate being provided on each side with an opacifying layer, each opacifying layer exhibiting at least one opening where the at least one window region is provided.

* * * * *